US010760837B2

(12) United States Patent
Lee

(10) Patent No.: US 10,760,837 B2
(45) Date of Patent: Sep. 1, 2020

(54) EVAPORATOR

(71) Applicant: Hanon Systems, Daejeon (KR)

(72) Inventor: Duck-Ho Lee, Daejeon (KR)

(73) Assignee: Hanon Systems, Daejeon (KR)

( * ) Notice: Subject to any disclaimer, the term of this patent is extended or adjusted under 35 U.S.C. 154(b) by 296 days.

(21) Appl. No.: 15/945,325

(22) Filed: Apr. 4, 2018

(65) Prior Publication Data

US 2018/0283748 A1 Oct. 4, 2018

(30) Foreign Application Priority Data

Apr. 4, 2017 (KR) ..... 10-2017-0043751
Mar. 21, 2018 (KR) ..... 10-2018-0032403

(51) Int. Cl.

| | |
|---|---|
| ***F25B 47/00*** | (2006.01) |
| ***F25B 39/02*** | (2006.01) |
| ***F25B 39/00*** | (2006.01) |
| ***F28F 9/02*** | (2006.01) |
| ***F28F 17/00*** | (2006.01) |
| ***F28D 1/053*** | (2006.01) |
| *F28F 1/12* | (2006.01) |
| *F28D 21/00* | (2006.01) |
| *F28F 1/02* | (2006.01) |

(52) U.S. Cl.

CPC ..... *F25B 47/00* (2013.01); *F25B 39/00* (2013.01); *F25B 39/02* (2013.01); *F28D 1/05391* (2013.01); *F28F 9/028* (2013.01); *F28F 9/0265* (2013.01); *F28F 17/005* (2013.01); *F28D 2021/0085* (2013.01); *F28F 1/02* (2013.01); *F28F 1/126* (2013.01); *F28F 2265/22* (2013.01); *F28F 2275/04* (2013.01)

(58) Field of Classification Search

CPC ..... F25B 39/02; F25B 39/028; F25B 47/00; F25B 39/00; F28F 9/0021; F28F 17/005; F28F 2265/22; F28F 9/0214; F28F 9/0217; F28F 9/0212; F28F 9/0204

See application file for complete search history.

(56) References Cited

U.S. PATENT DOCUMENTS

2014/0020425 A1* 1/2014 Hirayama ..... F28F 9/0224 62/515
2015/0000133 A1* 1/2015 Taras ..... F28F 17/005 29/890.035

FOREIGN PATENT DOCUMENTS

JP 2005308384 A 11/2005

* cited by examiner

*Primary Examiner* — Cassey D Bauer
(74) *Attorney, Agent, or Firm* — Norton Rose Fulbright US LLP; James R. Crawford

(57) ABSTRACT

Provided is an evaporator including a header in which a depressed portion is formed by concavely depressing downwards a transverse central portion in a longitudinal direction from an upper surface, the portion in which the depressed portion is formed protrudes downwards to form a pair of partitions spaced apart from each other, and a communication hole is formed in a penetrating manner in a transverse direction in each of the pair of partitions; a tank in which a transverse central portion is coupled to a lower end of the partition of the header and both sides in the transverse direction are coupled to the header; and an insert plate inserted into the depressed portion of the header such that both surfaces are tightly attached to the pair of partitions, and having a through hole provided at a position corresponding to the communication holes provided in the pair of partitions.

8 Claims, 12 Drawing Sheets

EVAPORATOR

CROSS-REFERENCE TO RELATED APPLICATIONS

This application claims priority under 35 U.S.C. § 119 to Korean Patent Application No. 10-2 017-0 04 37 51; filed on Apr. 4, 2017 and Korean Patent Application No. 10-2018-0032403, filed on Mar. 21, 2018, in the Korean Intellectual Property Office, the disclosure of which is incorporated herein by reference in its entirety.

TECHNICAL FIELD

The following disclosure relates to a dual evaporator including first and second rows allowing a refrigerant to flow separately, in which a header tank is partitioned by a partition to form a first compartment and a second compartment and the partition includes a communication hole connecting the first compartment and the second compartment.

BACKGROUND

Air conditioners for vehicles are installed to cool or heat the interior of vehicles during summer or winter or remove frost formed on wind shields when it rains or during the winter, and the like, to secure drivers' front or rear visual fields. Air-conditioners generally include both a heating system and a cooling system to selectively receive internal or external air, heat or cool the received air, and blow air to the inside of vehicles to cool or heat the inside or ventilate it.

A typical refrigerating cycle of such an air conditioner includes an evaporator for absorbing heat from the surroundings, a compressor for compressing a refrigerant, a condenser for releasing heat to the surroundings, and an expansion valve for expanding the refrigerant. In a cooling system, a gaseous refrigerant flowing to the compressor from the evaporator is compressed to have a high temperature and high pressure in the compressor, and when the compressed refrigerant in the gaseous state passes through the condenser and is liquefied, heat of liquefaction is released to the surroundings. The liquefied refrigerant passes through the expansion valve again to become low-temperature and low-pressure wet saturated steam, and then flows to the evaporator again and is vaporized to absorb the heat of vaporization from the surroundings to cool ambient air, thus cooling the inside of a vehicle.

The condenser, the evaporator, and the like, used in the cooling system are typical heat exchangers, and a lot of continuous research includes studies on effective heat exchange between ambient air of a heat exchanger and a heat exchange medium, i.e., a refrigerant, inside the heat exchanger. The most direct effect of indoor cooling is manifested by efficiency of evaporators, and thus, various structural research and development have been done and made to improve heat exchange efficiency of evaporators.

In order to enhance heat exchange efficiency of evaporators, an example having a dual-evaporation structure in which a core including tubes and fins are dually provided to form first and second rows as spaces in which a refrigerant flows therein has been proposed.

Conventionally, Japanese Patent Laid-Open Publication No. 2005-308384 ("Ejector Cycle", Nov. 4, 2005) discloses a configuration similar to a dual-evaporator in which a refrigerant flows in each of a first row and a second row.

Here, in the dual-evaporator, a header tank arranged on an upper side or a lower side is divided into two rows by a partition and a communication hole may be provided in the partition, which partitions first and second rows each allowing a refrigerant to flow therein, in order to connect the first and second rows to configure a flow path for flowing of a refrigerant.

However, the header tank does not have a drain hole in a portion corresponding to an intermediate position between the first row and the second row, making it difficult for condensate generated in refrigerant tubes and fins configuring the evaporator to be drained through the header tank when heat is exchanged.

In order to form a drain hole to drain condensate in the header tank, a portion corresponding to an intermediate position between the first and second rows may be narrowed to form a drain hole, but with this structure, it is difficult to form a communication hole connecting the first row and the second row and structural strength is so weak to degrade durability.

RELATED ART DOCUMENT

[Patent Document]

Japanese Patent Laid-Open Publication No. 2005-308384 A (Nov. 4, 2005)

SUMMARY

An embodiment is directed to providing an evaporator in which a drain hole to drain condensate is easily formed in a transverse central portion of a header tank formed in two rows, the degree of freedom of a size and position of a communication hole connecting first and second rows of the header tank is high, and durability of a portion in which the communication hole of the header tank is formed is high.

In one general aspect, an evaporator may include: a first header tank and a second header tank arranged abreast of each other and spaced apart from each other at a predetermined distance and partitioned by a partition to form a first row and a second row and to be divided into first compartment s and second compartments in a transverse direction; a plurality of tubes connected and fixed to the first header tank and the second header tank at both ends; and fins interposed between the plurality of tubes, wherein the second header tank includes a header in which a depressed portion is formed by concavely depressing downwards a transverse central portion in a longitudinal direction from an upper surface, the portion in which the depressed portion is formed protrudes downwards to form a pair of partitions spaced apart from each other, and a communication hole is formed in a penetrating manner in a transverse direction in each of the pair of partitions; a tank in which a transverse central portion is coupled to a lower end of the partition of the header and both sides in the transverse direction are coupled to the header; and an insert plate inserted into the depressed portion of the header such that both surfaces are tightly coupled to the pair of partitions, and having a through hole provided at a position corresponding to the communication holes provided in the pair of partitions.

The second header tank may include a condensate drain hole penetrating through the depressed portion in a vertical direction such that a lower external space of the tank and the depressed portion communicate with each other.

The insert plate may include a drainage flow path connecting an upper outer space of the header and the condensate drain hole.

The drainage flow path may include a first drainage flow path penetrating through both width-directional surfaces at a position spaced apart downwards from an upper end of the insert plate and a second drainage flow path connected to the first drainage flow path on an upper side and connected to the condensate drain hole on a lower side, and penetrating through both width-directional surfaces thereof.

The condensate drain holes may be provided in plurality and spaced apart from each other in the longitudinal direction, and the plurality of drainage flow paths may be provided in the insert plate and spaced apart from each other in the longitudinal direction to correspond to the condensate drain holes, respectively.

The first drainage flow path may extend to both sides in the longitudinal direction from an upper end of the second drainage flow path.

A fixing tab protrudes from a lower portion of the insert plate and a coupling hole vertically penetrating through the depressed portion is formed in the second header tank, so that the fixing tab may be inserted into the coupling hole and coupled therewith.

A vertically penetrating brazing ascertainment hole may be provided at a position corresponding to a portion in which the header is blocked, in a transverse central portion of the tank to which a lower end of the partition is coupled.

In another general aspect, an evaporator may include a first header tank and a second header tank arranged abreast of each other and spaced apart from each other at a predetermined distance and partitioned by a partition to form a first row and a second row and to be divided into first compartments and second compartments in a transverse direction; a plurality of tubes connected and fixed to the first header tank and the second header tank at both ends; and fins interposed between the plurality of tubes, wherein the second header tank includes a header in which a depressed portion is formed by concavely depressing downwards a transverse central portion in a longitudinal direction from an upper surface, the portion in which the depressed portion is formed protrudes downwards to form a pair of partitions spaced apart from each other, and a communication hole is formed in a penetrating manner in a transverse direction in each of the pair of partitions; and a tank in which a transverse central portion is coupled to a lower end of the partition of the header and both sides in the transverse direction are coupled to the header, wherein protrusions protruding from a circumferential portion of the communication hole in a transverse direction are formed in surfaces of the pair of partitions which face each other and the communication holes formed in the pair of partitions may be connected to each other.

The protrusions may protrude from the pair of partitions so that the protrusions facing each other may be in contact with each other.

The second header tank may include a condensate drain hole penetrating through the depressed portion in a vertical direction such that a lower external space of the tank and the depressed portion communicate with each other.

A plurality of communication holes may be formed in the pair of partitions and spaced apart from each other in the longitudinal direction, and protrusions are formed in the positions where the communication holes may be formed, the protrusions may be spaced apart from each other in the longitudinal direction, and the condensate drain holes may be formed in positions between the protrusions in the longitudinal direction.

A vertically penetrating brazing ascertainment hole may be provided at a position corresponding to a portion in which the header is blocked, in a transverse central portion of the tank to which a lower end of the partition is coupled.

In another general aspect, an evaporator may include: a first header tank and a second header tank arranged abreast of each other and spaced apart from each other at a predetermined distance and partitioned by a partition to form a first row and a second row and to be divided into first compartments and second compartments in a transverse direction; a plurality of tubes connected and fixed to the first header tank and the second header tank at both ends; and fins interposed between the plurality of tubes, wherein the second header tank includes a header in which a depressed portion is formed by concavely depressing downwards a transverse central portion in a longitudinal direction from an upper surface, the portion in which the depressed portion is formed protrudes downwards to form a pair of partitions spaced apart from each other, and a communication hole is formed in a penetrating manner in a transverse direction in each of the pair of partitions; a tank in which a transverse central portion is coupled to a lower end of the partition of the header and both sides in the transverse direction are coupled to the header; and a communication tube inserted into the communication holes respectively formed in the pair of partitions of the header and coupled at both ends thereof, wherein the communication holes formed in the pair of partitions may be connected to each other by the communication tube.

A flange may protrude outwardly from an outer circumferential surface of the communication tube at one end so that the flange may be caught by the partition adjacent to the first compartment or the second compartment.

A plurality of communication holes may be formed and spaced apart from each other in the header in the longitudinal direction, and the plurality of communication tubes may be separately formed and individually inserted and coupled to the communication holes.

The header includes a plurality of communication holes spaced apart from each other in the longitudinal direction, and the plurality of communication tubes may be provided and connected to each other by a communication portion.

A flange may protrude outwardly from an outer circumferential surface of the communication tube at one end so that the flange may be caught by the partition adjacent to the first compartment or the second compartment.

The second header tank may include a condensate drain hole penetrating through the depressed portion in a vertical direction such that a lower external space of the tank and the depressed portion communicate with each other.

A vertically penetrating brazing ascertainment hole may be provided at a position corresponding to a portion in which the header is blocked, in a transverse central portion of the tank to which a lower end of the partition is coupled.

Other features and aspects will be apparent from the following detailed description, the drawings, and the claims.

DETAILED DESCRIPTION OF EXEMPLARY EMBODIMENTS

The advantages, features and aspects of the present disclosure will become apparent from the following description of the exemplary embodiments with reference to the accompanying drawings, which is set forth hereinafter. The present disclosure may, however, be embodied in different forms and should not be construed as limited to the exemplary embodiments set forth herein. Rather, these exemplary embodiments are provided so that this disclosure will be thorough and complete, and will fully convey the scope of the present disclosure to those skilled in the art. The terminology used herein is for the purpose of describing particular exemplary embodiments only and is not intended to be limiting of example exemplary embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Hereinafter, an evaporator having the aforementioned configuration according to exemplary embodiments will be described in detail with reference to the accompanying drawings.

EXEMPLARY EMBODIMENT 1

Figure 1:
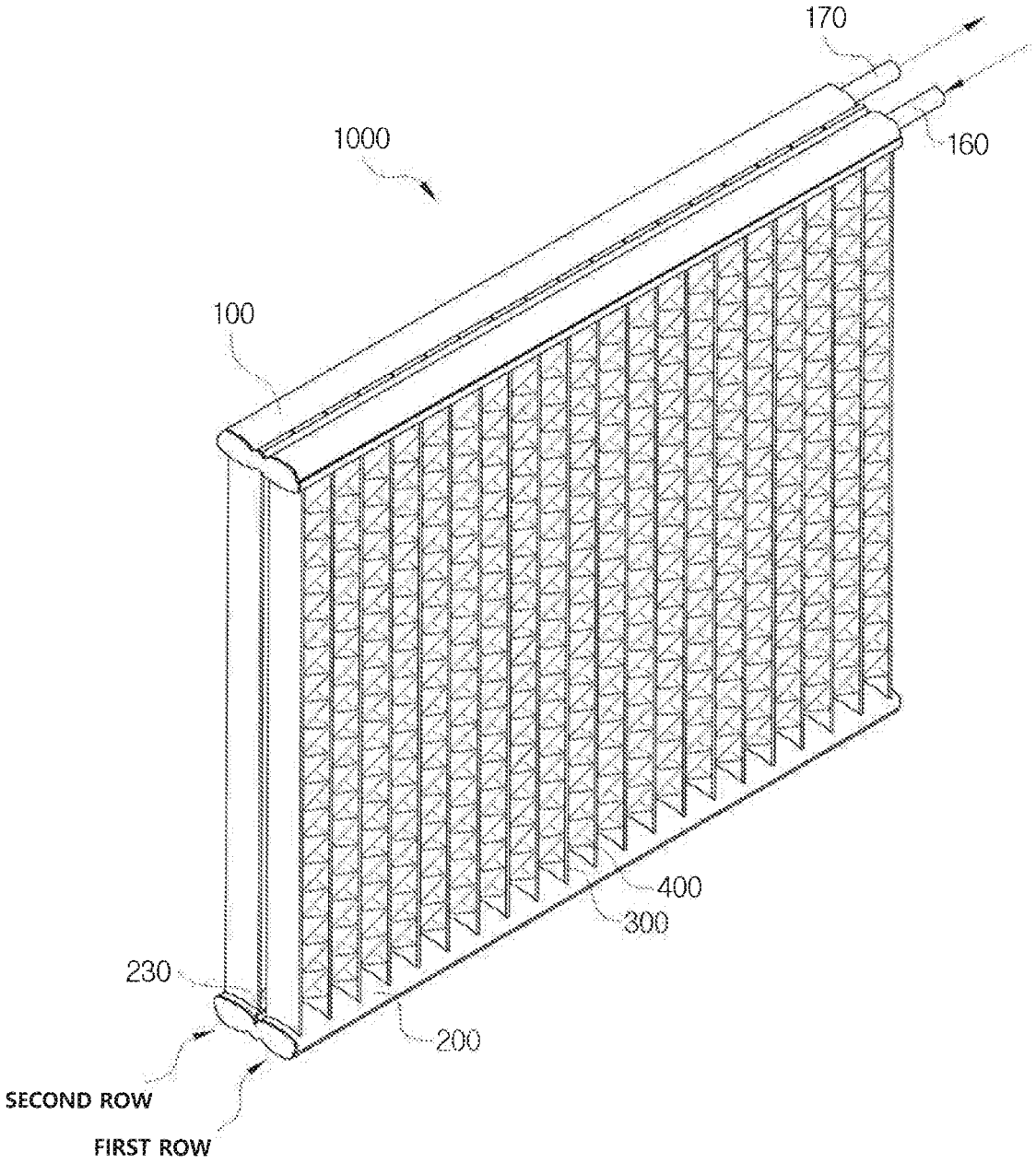
FIGS. 1 and 2 are an assembled perspective view and a partially exploded perspective view of an evaporator according to a first exemplary embodiment, respectively.
Figure 2:
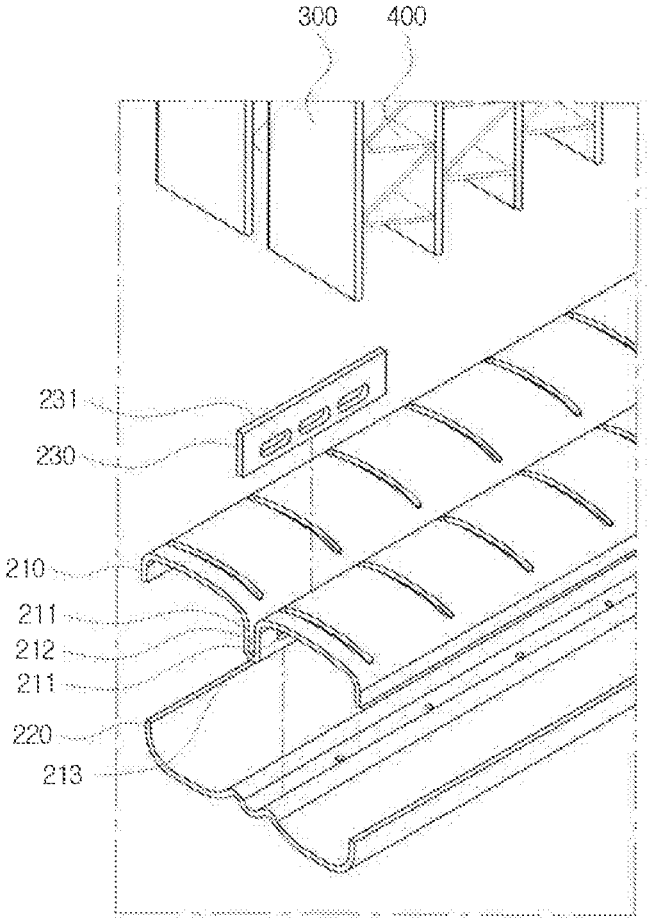
Figure 3:
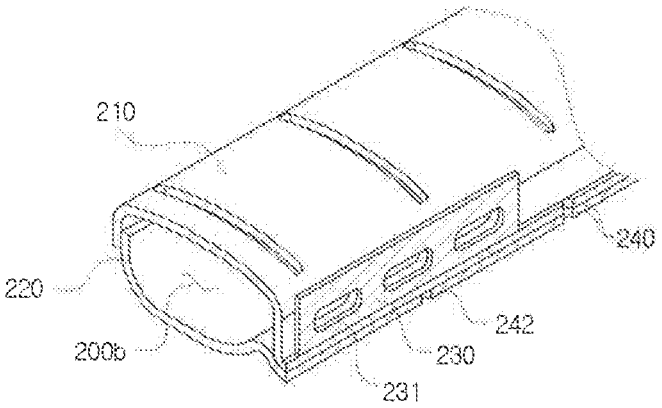
FIGS. 3 and 4 are a partial cross-sectional perspective view and a cross-sectional view of a header, a tank, and an insert plate of a second header tank according to the first exemplary embodiment, respectively.
Figure 4:
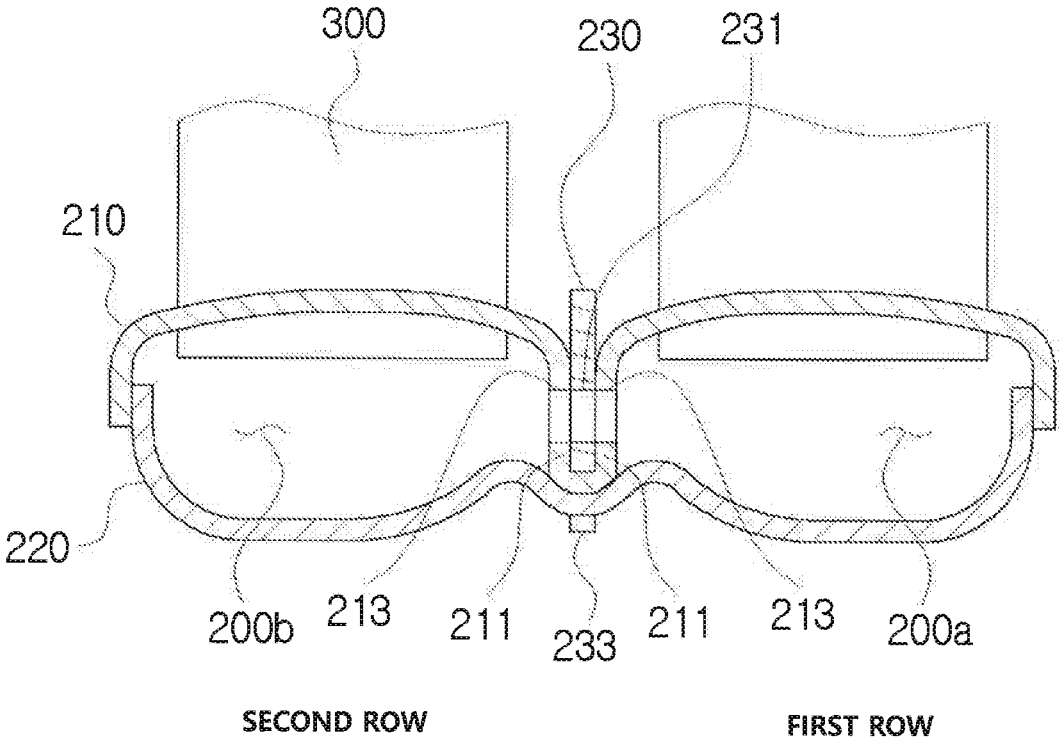

FIGS. 1 and 2 are an assembled perspective view and a partially exploded perspective view of an evaporator according to a first exemplary embodiment, respectively, and FIGS. 3 and 4 are a partial cross-sectional perspective view and a cross-sectional view of a header, a tank, and an insert plate of a second header tank according to the first exemplary embodiment, respectively.

As illustrated, the evaporator 1000 according to the first exemplary embodiment may include; a first header tank 100 and a second header tank 200 arranged abreast of each other and spaced apart from each other at a predetermined distance and partitioned by a partition to form a first row and a second row and to be divided into first compartments 100*a* and 200*a* and second compartments 100*b* and 200*b* in a transverse direction; a plurality of tubes 300 connected and fixed to the first header tank 100 and the second header tank 200 at both ends; and fins 400 interposed between the plurality of tubes 300, wherein the second header tank 200 includes a header 210 in which a depressed portion 212 is formed by concavely depressing downwards a transverse central portion in a longitudinal direction from an upper surface, the portion in which the depressed portion 212 is formed protrudes downwards to form a pair of partitions 211 spaced apart from each other, and a communication hole 213 is formed in a penetrating manner in a transverse direction in each of the pair of partitions 211; a tank 220 in which a transverse central portion is coupled to a lower end of the partition 211 of the header 210 and both sides in the transverse direction are coupled to the header 210; and an insert plate 230 inserted into the depressed portion 212 of the header 210 such that both surfaces are tightly coupled to the pair of partitions 211, and having a through hole 231 provided at a position corresponding to the communication holes 213 provided in the pair of partitions 211.

The evaporator of the present disclosure may include a first header tank 100, a second header tank 200, a tube 300 and a fin 400. Here, inner spaces of the first header tank 100 and the second header tank 200 may be partitioned by the partitions and refrigerant flow paths in which a refrigerant may flow may be arranged in two rows in a longitudinal direction. Thus, the first compartment 100*a* and the second compartment 100*b* of the first header tank 100 may be formed by coupling the header 110 and the tank 120, and the first compartment 200*a* and the second compartment 200*b* of the second header tank 200 may be formed by coupling the header 210 and the tank 220. Also, a plurality of tubes 300 may be coupled and fixed such that both ends thereof are connected to the first compartment 100*a* of the first header tank 100 and the first compartment 200*a* of the second header tank 200 forming a fist row, and a plurality of tubes 300 may be coupled and fixed such that both ends thereof are also connected to the second compartment 100*b* of the first header tank 100 and the second compartment 200*b* of the second header tank 200 forming the second row. The fins 400 are interposed and coupled between the tubes 300 forming the first row, and the fins 400 are interposed and coupled between the tubes 300 forming the second row. Accordingly, the first row and the second row may be stacked and coupled abreast of each other.

Here, the second header tank 200 may include the header 210, the tank 220, and the insert plate 230. The header 210 is a part combined with the tank 220 (to be described later) to form a space in which the refrigerant may flow. The header 210 includes a depressed portion 212 formed by concavely depressing a transverse central portion between a portion in which the first compartment 200*a* is formed and a portion in which the second compartment 200*b* is formed, downwards from an upper surface in a longitudinal direction. The portion in which the depressed portion 212 is formed protrudes downwards such that the pair of partitions 211 are spaced apart from each other in the transverse direction, and lower ends of the pair of partitions 211 may be connected to each other in the transverse direction. Here, as illustrated, in the header 210, the portion in which the depressed portion 212 is formed has a U-shape concavely downwards by bending a single plate member, and the portion in which the first compartment 200*a* and the second compartment 200*b* are formed may be curved upwards to be slightly convex. A tube insertion hole penetrating through upper and lower surfaces may be formed in the curved portion, so that after an end of the tube 300 is inserted into the tube insertion hole, the header 210 and the tubes 300 may be coupled through brazing, and width-directional both sides of the header 210 may be bent downwards.

The tank 220 is another part which is combined with the header 210 and forms a space in which the refrigerant may flow. A portion of the tank 220 forming the first compartment 200*a* and the second compartment 200*b* may be curved to be convex downwards, and width-directional both sides may be bent upwards and the bent portions are coupled to the both bent portions of the header 210 and joined through brazing, or the like. The transverse central portion of the tank 220 may be coupled to be in contact with lower ends of the partitions 211 of the header 210 and joined through brazing, or the like. Here, the transverse central portion of the tank 220 may include a seating recess concave in a longitudinal direction such that lower ends of the partitions 211 of the header 210 may be inserted and seated as illustrated.

The insert plate 230 may be formed as a plate extending in a height direction and a longitudinal direction so as to be longer than a thickness in a transverse direction. The insert plate 230 may be inserted into the depressed portion 212 of the header 210 such that both surfaces of the insert plate 230 are tightly attached to the pair of partitions 211. Here, a lower end surface of the insert plate 230 may be in contact with a bottom surface of the depressed portion 212 and supported, and both surfaces of the insert plate 230 may be joined through brazing, or the like, in a state of being tightly attached to the pair of partitions 211. The insert plate 230 includes a through hole 231 to correspond to the communication holes 213 provided in the pair of partitions 211, and the communication hole 213 provided in one partition 211, the through hole 231 of the insert plate 230, and the communication hole 213 provided in the other partition 211 may communicate in a transverse direction. Here, a plurality of communication holes 213 provided in the partition 211 may be spaced apart from each other in a longitudinal direction, and the insert plate 230 is also formed to extend such that a length thereof is longer in a longitudinal direction than in a height direction such that the through holes 231 are formed in positions corresponding to the communication holes 213. Accordingly, the insert plate 230 with the through holes 231 serves as a connection passage connecting the communication holes formed in one partition 211 and the communication holes 213 formed in the other partition 211 and serves as a structure firmly combining the two separated partitions 211.

Accordingly, in the evaporator of the present disclosure, it is easy to form a drain hole to drain condensate in the depressed portion, which is a transverse central portion of a header tank in the header tank formed in two rows, the degree of freedom in a formation size and position of the communication hole connecting the first compartment and the second compartment as the first row and the second row of the header tank is high, and durability of the portion in which the communication hole of the header tank is formed is high.

The second header tank 200 may include a condensate drain hole 240 penetrating through the depressed portion 212 in a vertical direction such that an external space below the tank 220 and the depressed portion 212 communicate with each other.

That is, the condensate drain hole 240 penetrating through a portion in which the central portion of the header 210 and the central portion of the tank 220 are coupled may be formed in the portion in which the depressed portion 212 is formed, and since the depressed portion 212 and an external space below the tank 220 are connected by the condensate drain hole 240, condensate drained down on a surface of the tubes 300 may gather in the depressed portion 212 and may be drained to a lower side of the second header tank 200 through the condensate drain hole 240, Here, a plurality of condensate drain holes 240 may be spaced apart from each other in a longitudinal direction in a portion in which the depressed portion 212 is formed.

Figure 5:
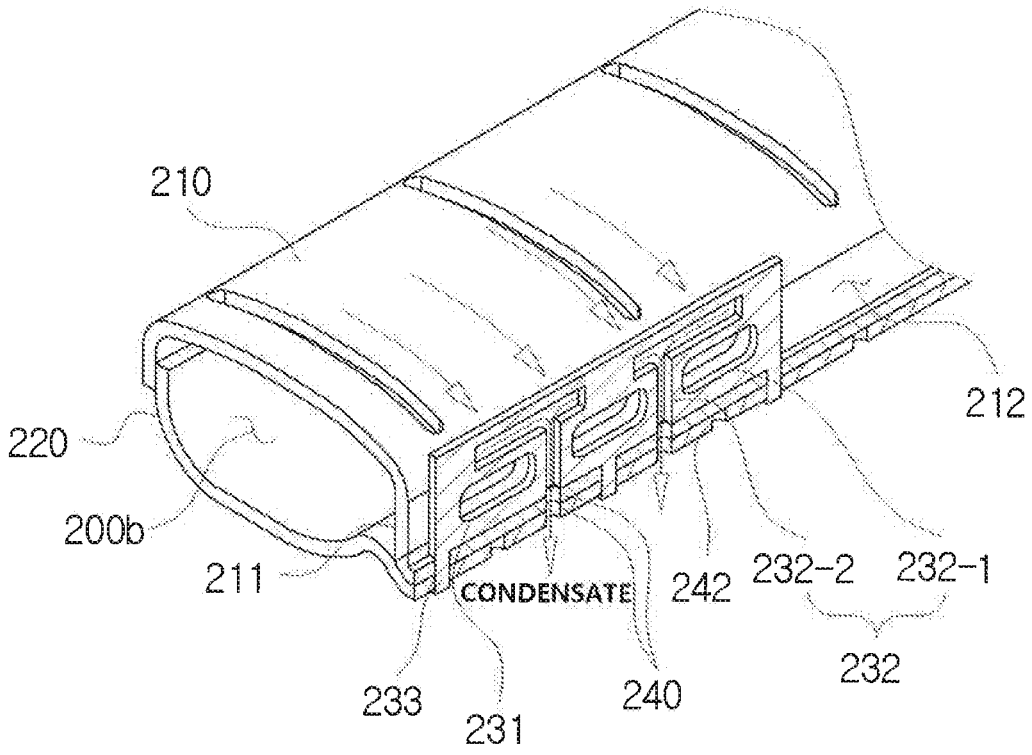
FIGS. 5 to 7 are partial cross-sectional perspective views illustrating a modification of the header, the tank, and the insert plate of the second header tank according to the first exemplary embodiment.
Figure 6:
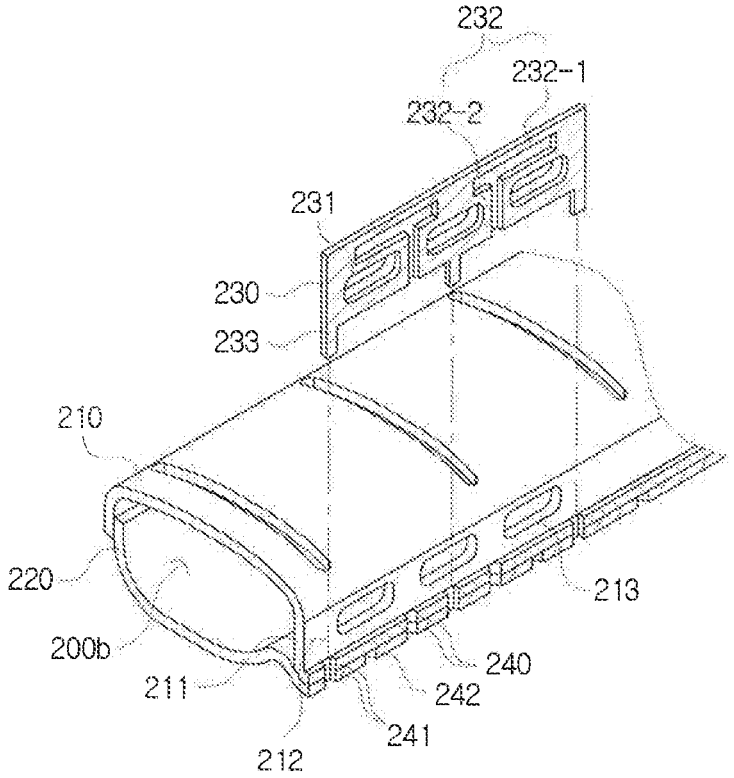
Figure 7:
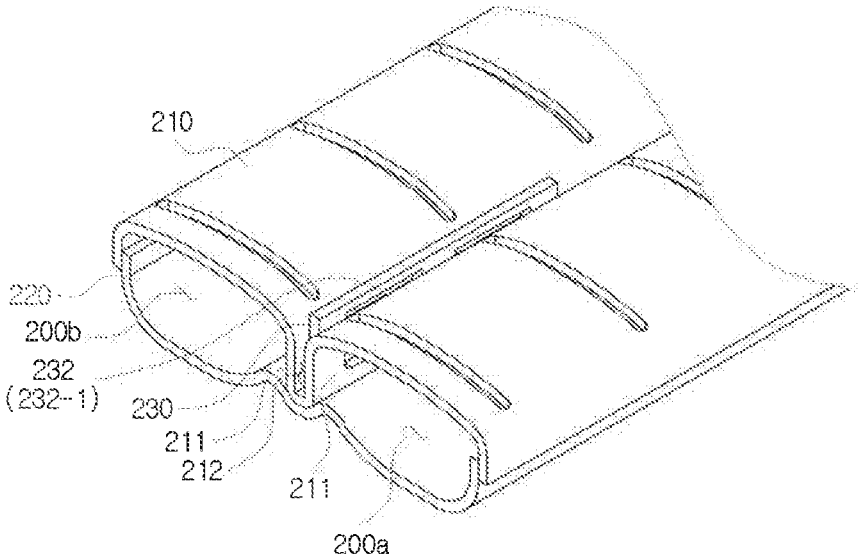

FIGS. 5 to 7 are partial cross-sectional perspective views illustrating a modification of the header, the tank, and the insert plate of the second header tank according to the first exemplary embodiment.

As illustrated, the insert plate 230 may include a drainage flow path 232 connecting an upper outer space of the header 210 and the condensate drain hole 240.

That is, in case where the condensate drain hole 240 is provided on a lower side of the insert plate 230, condensate, which may be collected on an upper side of the insert plate 230 or on an upper side of the header 210, may flow along the drainage flow path 232 formed in the insert plate 230 and may be discharged through the condensate drain hole 240. Accordingly, the condensate drain hole 240 may also be provided even at the length-directional section of the second header tank 200 in which the insert plate 230 is present, and condensate which may gather on both width-directional upper sides of the insert plate 230 may easily be drained.

The drainage flow path 232 may include a first drainage flow path 232-1 penetrating through both width-directional surfaces at a position spaced apart downwards from an upper end of the insert plate 230 and a second drainage flow path 232-2 connected to the first drainage flow path 232-1 on an upper side and connected to the condensate drain hole 240 on a lower side, and penetrating through both width-directional surfaces thereof.

This is an example of the drainage flow path 232 formed in the insert plate 230. As illustrated, the drainage flow path 232 may be formed to penetrate through both surfaces of the insert plate 230 in the transverse direction. The insert plate 230 may protrude to be exposed to an upper side of the depressed portion 212 and the drainage flow path 232 may be perforated to penetrate through both surfaces thereof in the transverse direction. The drainage flow path 232 may include the first drainage flow path 232-1 provided in a longitudinal direction at a position slightly spaced from the upper end of the drainage flow path 232 in the height direction downwards and the second drainage flow path 232-2 provided in the height direction, so that the upper side of the second drainage flow path 232-2 may be connected to the first drainage flow path 232-1 and a lower side of the second drainage flow path 232-2 may be connected to the condensate drain hole 240. Accordingly, the drainage flow path 232 may easily be formed, and condensate may easily gather toward the second drainage flow path 232-2 along the first drainage flow path 232-1 formed in the longitudinal direction, The condensate drain holes 240 are provided in plurality and the plurality of condensate drain holes 240 are spaced apart from each other in the longitudinal direction. The plurality of drainage flow paths 232 may be provided in the insert plate 230 and spaced apart from each other in the longitudinal direction to correspond to the condensate drain holes 240, respectively.

That is, when the plurality of condensate drain holes 240 are provided, the drainage flow paths 232 may be formed in the insert plate 230 in positions corresponding to the condensate drain holes 240 spaced apart from each other, respectively. Here, the first drainage flow path 232-1 may be provided, at a position spaced apart from both ends in the longitudinal direction of the insert plate 230. When the plurality of drainage flow paths 232 are formed as illustrated, the first drainage flow paths 232-1 are spaced apart from each other, rather than being connected to each other, so that the insert plate 230 may be integrally formed without being divided into several separate parts by virtue of the drainage flow paths 232.

In addition, the first drainage flow path 232-1 may extend to both sides in the longitudinal direction from an upper end of the second drainage flow path 232-2.

That is, as illustrated, in the drainage flow path 232 formed in the insert plate 230, the first drainage flow path 232-1 extends to both sides in the longitudinal direction from the upper end of the second drainage flow path 232-2 formed in a height direction to form a T-shaped drainage flow path 232.

A fixing tab 233 protrudes from a lower portion of the insert plate 230 and a coupling hole 241 vertically penetrating through the depressed portion 212 is formed in the second header tank 200, so that the fixing tab 233 may be inserted into the coupling hole 241 and coupled therewith.

That is, the fixing tabs 233 protrude downwards from a lower end of the insert plate 230, and the vertically penetrating coupling holes 241 are formed in a portion where the depressed portion 212 of the second header tank 200 is formed. As the fixing taps 233 are inserted and coupled to the coupling holes 241, a length-directional position of the insert plate 230 may be fixed. Here, as for the coupling holes 241 provided in the second header tank 200, some of the condensate drain holes 240 may be used as the coupling holes 241. In a state of being inserted and coupled to the coupling holes 241, the fixing taps 233 of the insert plate 230 may protrude downwards, relative to a lower surface of a central portion of the tank 220 and protruding portions may be caulked through compression, bending, or the like, such that the insert plate 230 may not be released upwards in the height direction opposite to a direction in which the insert plate 230 is inserted.

A vertically penetrating brazing ascertainment hole 242 may be provided at a position corresponding to a portion in which the header 210 is blocked, in a transverse central portion of the tank 220 to which a lower end of the partition 211 of the header 210 is coupled.

That is, since the transverse central portion of the header 210 and the transverse central portion of the tank 220 may be joined to each other through brazing, the brazing ascertainment hole 242 may be formed at the transverse central portion of the tank 220 in contact with the lower end of the partition 21, the transverse central portion of the header 210 to ascertain whether the joined portion is completely sealed. Here, the brazing ascertainment hole 242 is formed at a position corresponding to a blocked portion without the condensate drain hole 240 at the central portion of the header 210, is joined using brazing. Thereafter, it is inspected whether leakage occurs when a gas having specific pressure is injected through the brazing ascertainment hole 242 to confirm whether the joined portion based on brazing is completely sealed. The brazing ascertainment hole 242 may be provided in plurality in a longitudinal direction, which are spaced apart from each other.

EXEMPLARY EMBODIMENT 2

Figure 8:
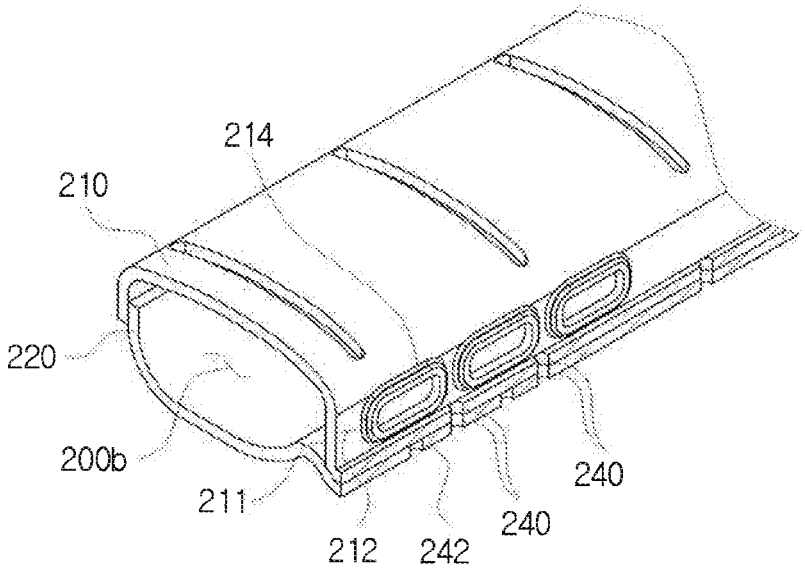
FIGS. 8 and 9 are a partial cross-sectional perspective view and a cross-sectional view illustrating a coupling structure of a header, a tank, and an insert plate of a second header tank according to a second exemplary embodiment, respectively.
Figure 9:
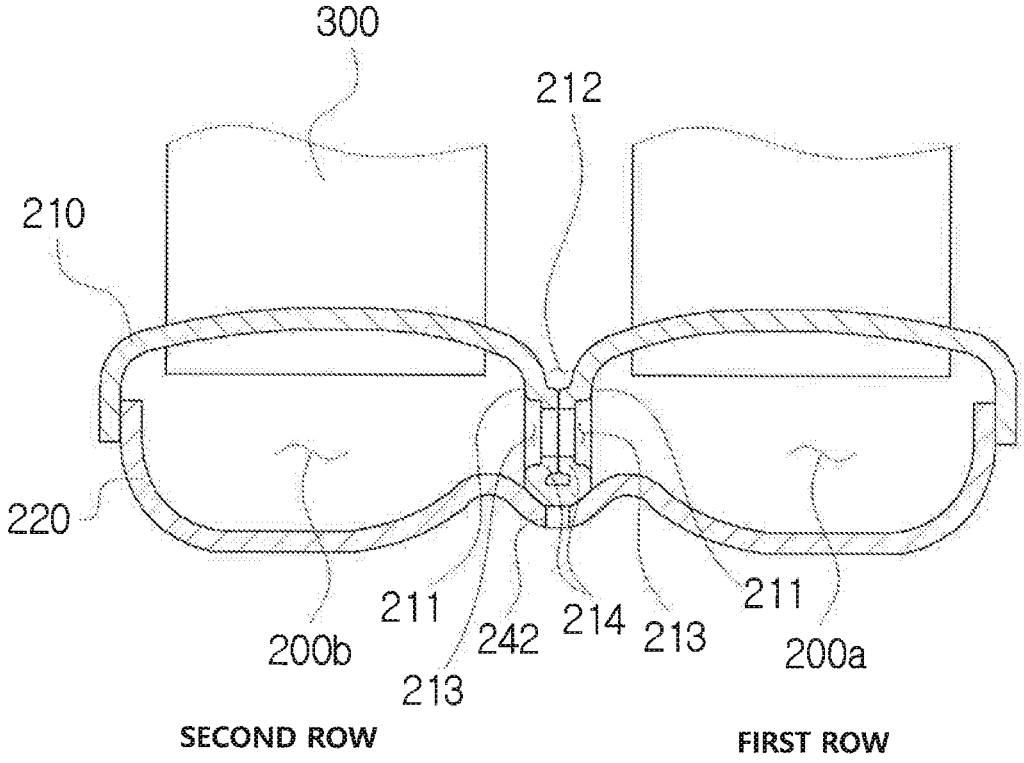

FIGS. 8 and 9 are a partial cross-sectional perspective view and a cross-sectional view illustrating a coupling structure of a header, a tank, and an insert plate of a second header tank according to a second exemplary embodiment, respectively.

As illustrated in the drawings, the evaporator 1000 according to the second exemplary embodiment may include: a first header tank 100 and a second header tank 200 arranged abreast of each other and spaced apart from each other at a predetermined distance and partitioned by a partition 111 to form a first row and a second row and to be divided into first compartments 100*a* and 200*a* and second compartments 100*b* and 200*b* in a transverse direction; a plurality of tubes 300 connected and fixed to the first header tank 100 and the second header-tank 200 at both ends; and fins 400 interposed between the plurality of tubes 300, wherein the second header tank 200 includes a header 210 in which a depressed portion 212 is formed by concavely depressing downwards a transverse central portion in a longitudinal direction from an upper surface, the portion in which the depressed portion 212 is formed protrudes downwards to form a pair of partitions 211 spaced apart from each other, and a communication hole 213 is formed in a penetrating manner in a transverse direction in each of the pair of partitions 211; and a tank 220 in which a transverse central portion is coupled to a lower end of the partition 211 of the header 210 and both sides in the transverse direction are coupled to the header 210, wherein protrusions 214 protruding from a circumferential portion of the communication hole 213 in a transverse direction are formed in surfaces of the pair of partitions 211 of the header 210 which face each other and the communication holes 213 formed in the pair of partitions 211 may be connected to each other by the protrusion 214.

This is because although a basic structure of the evaporator is similar to that of the first exemplary embodiment, the protrusions 214 protrude from the circumferential portion of the communication hole 213 in the width direction in the pair of facing partitions 211, instead of inserting a separate insert plate into the depressed portion to couple the same, so that the communication hole 213 formed in one partition 211 and the facing communication hole 213 formed in the other partition are connected by the protrusion 214.

More specifically, the evaporator of the present disclosure may include a first header tank 100, a second header tank 200, a tube 300 and a fin 400. Here, inner spaces of the first header tank 100 and the second header tank 200 may be partitioned by the partitions 111 and 211 and refrigerant flow paths in which a refrigerant may flow may be arranged in two rows in a longitudinal direction. Thus, the first compartment 100*a* and the second compartment 100*b* of the first header tank 100 may be formed by coupling the header 110 and the tank 120, and the first compartment 200*a* and the second compartment 200*b* of the second header tank 200 may be formed by coupling the header 210 and the tank 220. Also, a plurality of tubes 300 may be coupled and fixed such that both ends thereof are connected to the first compartment 100*a* of the first header tank 100 and the first, compartment 200*a* of the second header tank 200 forming the first row, and a plurality of tubes 300 may be coupled and fixed such that both ends thereof are also connected to the second compartment 100*b* of the first header tank 100 and the second compartment 200*b* of the second header tank 200 forming the second row. The fins 400 are interposed and coupled between the tubes 300 forming the first row, and the fins 400 are interposed and coupled between the tubes 300 forming the second row. Accordingly, the first row and the second row may be stacked and coupled abreast of each other.

Here, the second header tank 200 may include the header 210 and the tank 220. The header 210 is a part combined with the tank 220 to form a space in which the refrigerant may flow. The header 210 includes a depressed portion 212 formed by concavely depressing a transverse central portion between a portion in which the first compartment 200*a* is formed and a portion in which the second compartment 200*b* is formed, downwards from an upper surface in a longitudinal direction. The portion in which the depressed portion 212 is formed protrudes downwards such that the pair of partitions 211 are spaced apart from each other in the transverse direction, and lower ends of the pair of partitions 211 may be connected to each other in the transverse direction. Here, as illustrated, in the header 210, the portion in which the depressed portion 212 is formed has a U-shape concavely downwards by bending a single plate member, and the portion in which the first compartment 200*a* and the second compartment 200*b* are formed may be curved upwards to be slightly convex. A tube insertion hole penetrating through upper and lower surfaces may be formed in the curved portion, so that after an end of the tube 300 is inserted into the tube insertion hole, the header 210 and the tubes 300 may be coupled through brazing, and both sides of the header 210 in a transverse direction may be bent downwards.

The tank 220 is another part which is combined with the header 210 and forms a space in which the refrigerant may flow. A portion of the tank 220 forming the first compartment 200*a* and the second compartment 200*b* may be curved to be convex downwards, and both sides in a transverse direction may be bent upwards and the bent portions are coupled to the both bent portions of the header 210 and joined through brazing, or the like. The transverse central portion of the tank 220 may be coupled to be in contact lower ends of the partitions 211 of the header 210 and joined through brazing, or the like. Here, the transverse central portion of the tank 220 may include a seating recess concave in a longitudinal direction such that lower ends of the partitions 211 of the header 210 may be inserted and seated as illustrated.

Here, the header 210 may include a communication hole 213 perforated to penetrate through both surfaces of the pair of partitions 211 in the transverse direction. The protrusion 214 may protrude from a circumferential portion of the communication hole 213 in the pair of facing partitions 211 in the transverse direction.

The protrusion 214 may be integrally formed with the partition 211 of the header 210 using pressing, or the like, and may protrude from the partition 211. The protrusions 214 protruding from the pair of the partitions 211 may extend toward the center of the communication hole 213 in a longitudinal direction and a height direction from end portions protruding from the partitions in the transverse direction to form a sufficient joining area in the portion where the protrusions 214 are in contact with each other to join together.

Accordingly, the protrusions 214 serve as a connection passage for connecting the communication hole 213 formed in one partition 211 and the communication hole 213 formed in the other partition 211 and serve as a structure firmly combining the two separated partitions 211.

Accordingly, in the evaporator of the present disclosure, it is easy to form a drain hole to drain condensate in the depressed portion, which is a transverse central portion of a header tank in the header tank formed in two rows, the degree of freedom in a formation size and position of the communication hole connecting the first compartment and the second compartment as the first row and the second row of the header tank is high, and durability of the portion in which the communication hole of the header tank is formed is high.

The protrusions 214 may protrude from the pair of partitions 211 so that the protrusions 214 on both sides facing each other may be in contact with each other.

That is, as illustrated, the protrusions 214 protrude in a facing direction in the two partitions 211 and the facing protrusions may be in contact with each other so as to be joined through brazing, or the like. In addition, the protrusion 214 may protrude only from one partition 211, an end of the protruding protrusion 214 may be in contact with a circumferential portion of the communication hole 213 of the other partition 211, and surfaces in contact with each other may be joined through brazing, or the like.

The second header tank 200 may include a condensate drain hole 240 penetrating through the depressed portion 212 in a vertical direction such that an external space below the tank 220 and the depressed portion 212 communicate with each other.

That is, as in the first exemplary embodiment, in the second exemplary embodiment, the condensate drain hole 240 penetrating through a portion where the central portion of the header 210 and the central portion of the tank 220 are coupled may be formed in the portion in which the depressed portion 212 is formed.

In addition, a plurality of communication holes 213 may be formed in the pair of partitions 211 and spaced apart from each, other in the longitudinal direction, and protrusions 214 are formed in the positions where the communication holes 213 are formed. The protrusions 214 may be spaced apart from each other in the longitudinal direction, and the condensate drain holes 240 may be formed in positions between the protrusions 214 in the longitudinal direction.

That is, as illustrated, when a plurality of communication holes 213 are formed and spaced apart from each other in the longitudinal direction in one partition 211, the protrusions 214 are formed in the communication holes 213, respectively and may be spaced apart from each other in the longitudinal direction. The condensate drain hole 240 is formed between the protrusions 214 in the longitudinal direction so that condensate on the upper side of the second header tank 200 may flow between the protrusions 214 spaced apart from each other in the longitudinal direction and may easily be drained through the condensate drain hole 240.

A vertically penetrating brazing ascertainment hole 242 may be provided at a position corresponding to a portion in which the header 210 is blocked, in a transverse central portion of the tank 220 to which a lower end of the partition 211 of the header 210 is coupled.

That is, as in the first exemplary embodiment, in the second exemplary embodiment, the brazing ascertainment hole 242 is also formed and joined using brazing, and thereafter, it is inspected whether leakage occurs when a gas having specific pressure is injected through the brazing ascertainment hole 242 to confirm whether the joined portion based on brazing is completely sealed.

EXEMPLARY EMBODIMENT 3

Figure 10:
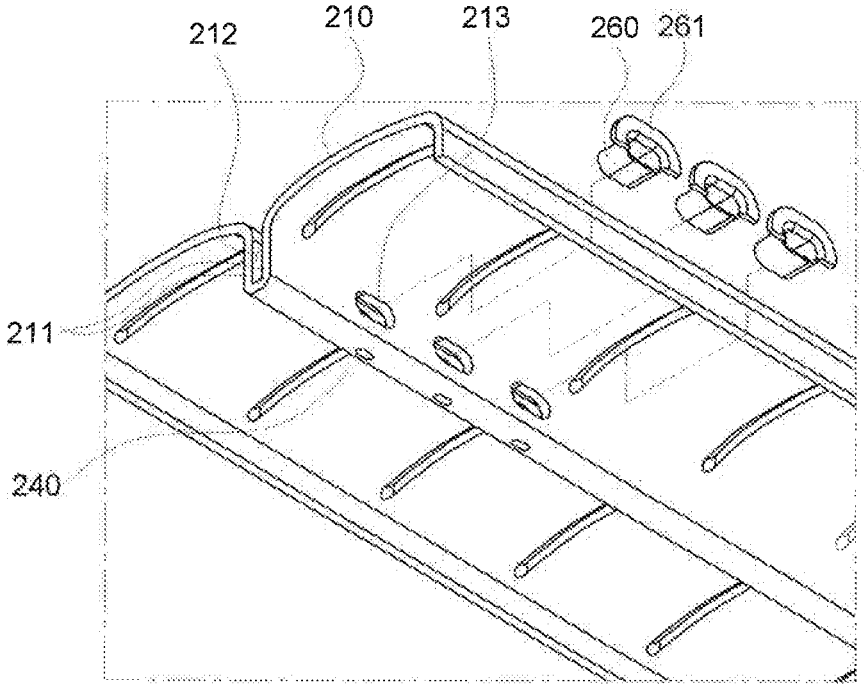
FIGS. 10 to 12 are an exploded perspective view, an assembled perspective view, and a cross-sectional view illustrating a coupling structure of a header, a tank, and an insert plate of a second header tank according to a third exemplary embodiment, respectively.
Figure 11:
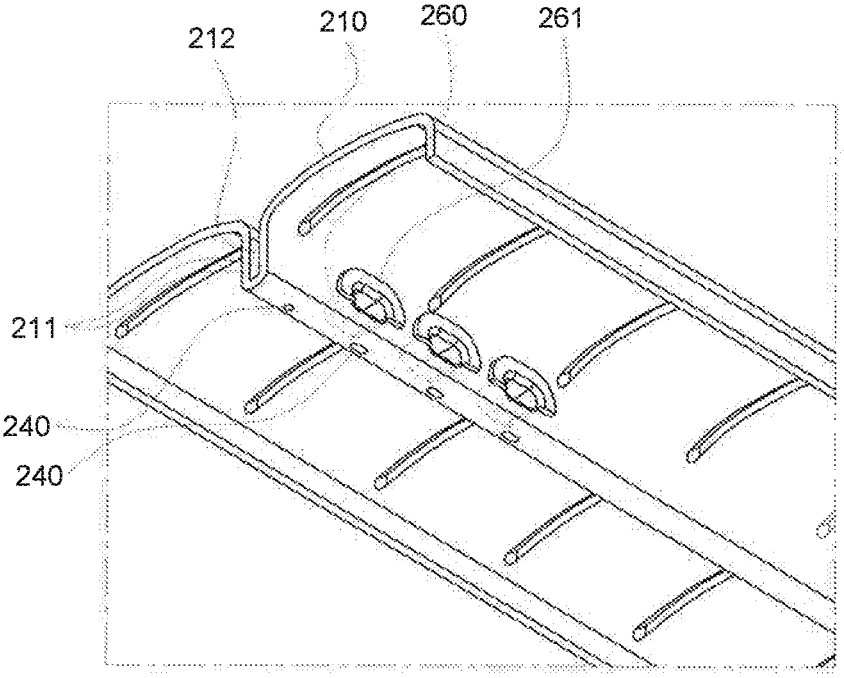
Figure 12:
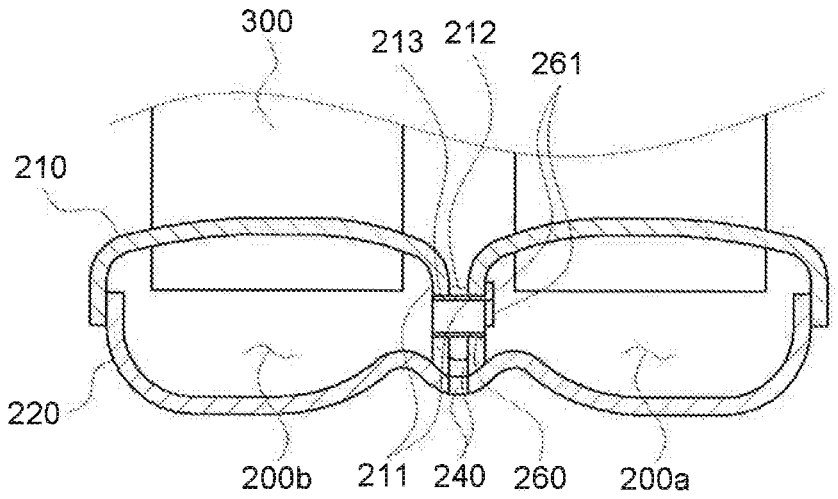
Figure 13:
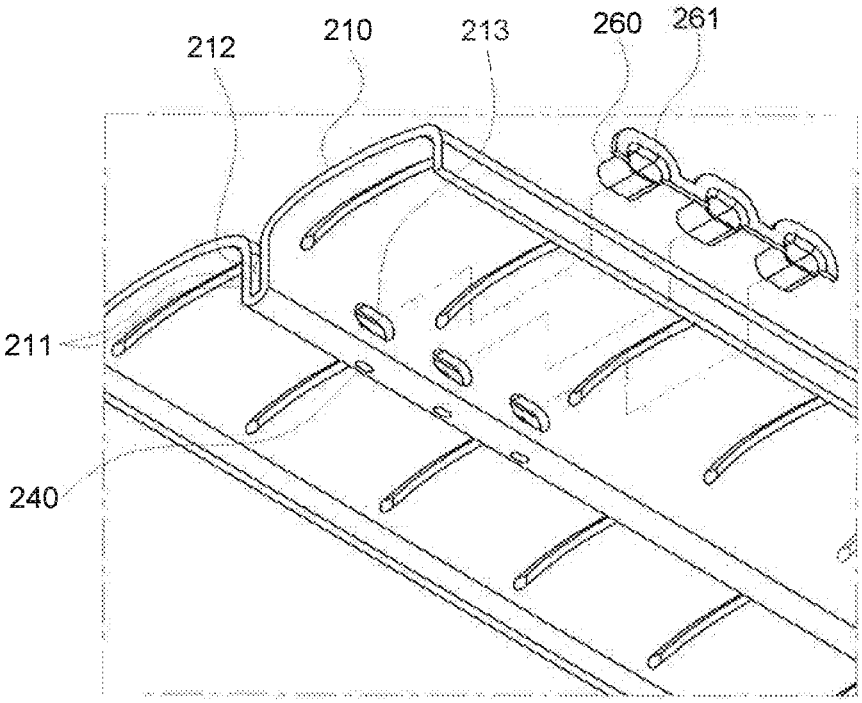
FIGS. 13 to 17 are exploded perspective views, assembled perspective views, and a cross-sectional view illustrating a modification of the header, the tank, and the insert plate of the second header tank according to the third exemplary embodiment, respectively.
Figure 14:
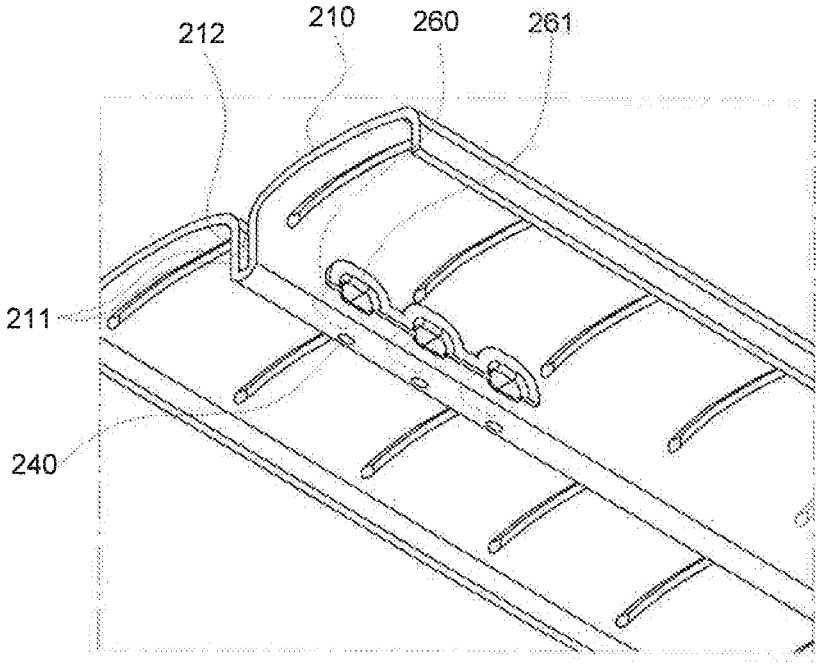
Figure 15:
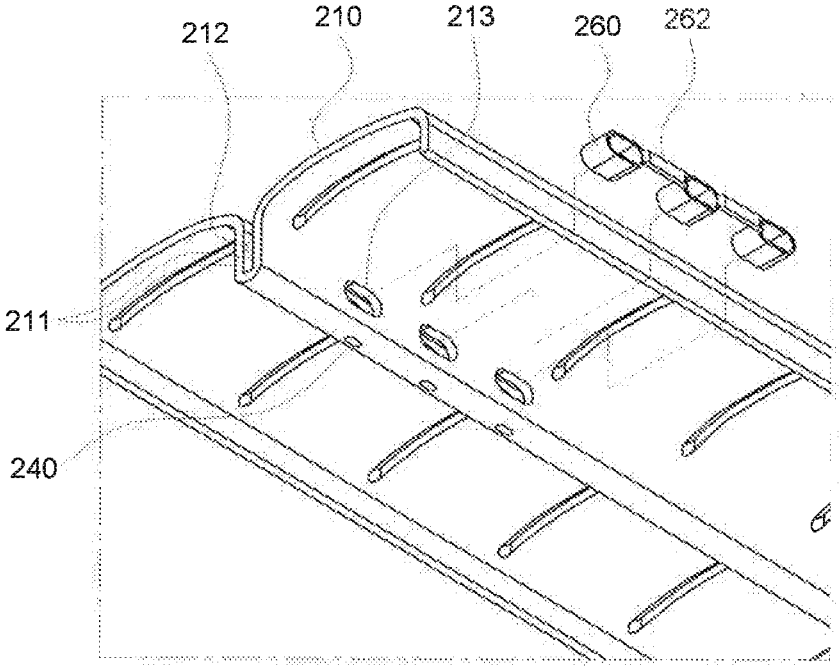
Figure 16:
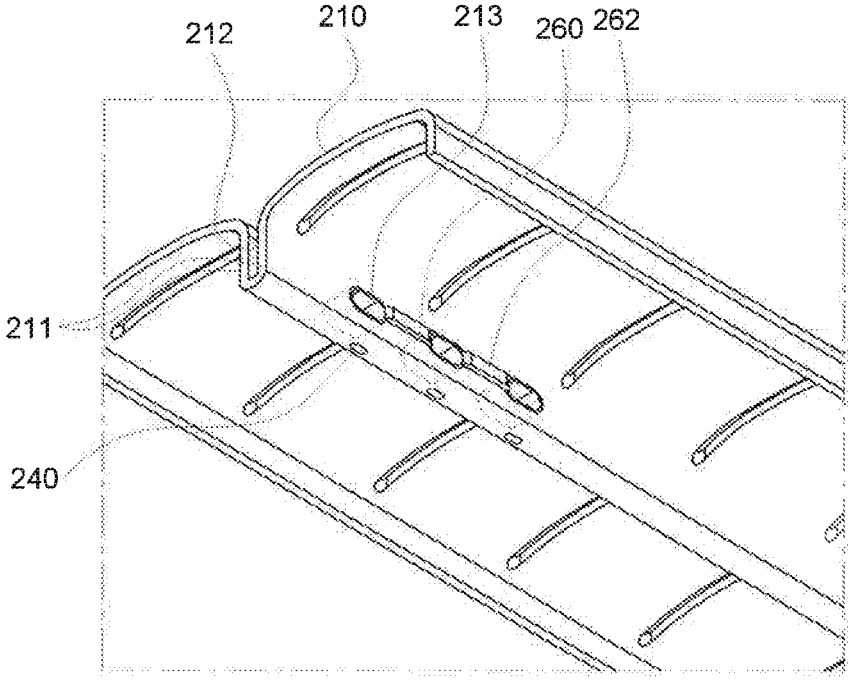
Figure 17:
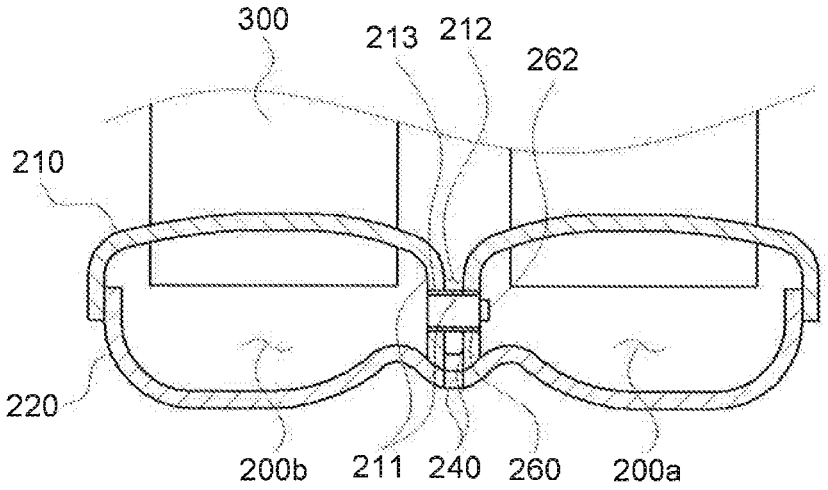

FIGS. 10 to 12 are an exploded perspective view, an assembled perspective view, and a cross-sectional view illustrating a coupling structure of a header, a tank, and an insert plate of a second header tank according to a third exemplary embodiment, respectively.

As illustrated in the drawings, the evaporator 1000 according to the third exemplary embodiment may include: a first header tank 100 and a second header tank 200 arranged abreast of each other and spaced apart from each other at a predetermined distance and partitioned by a partition 111 to form a first row and a second row and to be divided into first compartments 100*a* and 200*a* and second compartments 100*b* and 200*b* in a transverse direction; a plurality of tubes 300 connected and fixed to the first header tank 100 and the second header tank 200 at both ends; and fins 400 interposed between the plurality of tubes 300, wherein the second header tank 200 includes a header 210 in which a depressed portion 212 is formed by concavely depressing downwards a transverse central portion in a longitudinal direction from an upper surface, the portion in which the depressed portion 212 is formed protrudes downwards to form a pair of partitions 211 spaced apart from each other, and a communication hole 213 is formed in a penetrating manner in a transverse direction in each of the pair of partitions 211; a tank 220 in which a transverse central portion is coupled to a lower end of the partition 211 of the header 210 and both sides in the transverse direction are coupled to the header 210; and a communication tube 260 inserted into the communication holes 213 respectively formed in the pair of partitions 211 of the header 210 and coupled at both ends thereof, wherein the communication holes 213 formed in the pair of partitions 211 may be connected to each other by the communication tube 260.

This is because although a basic structure of the evaporator is similar to that of the first or second exemplary embodiment, the communication tube 260 is inserted into the communication holes 213 formed respectively in the pair of partitions 211 facing each other such that one end of the communication tube 260 is inserted into the communication hole 213 formed in one partition 211 and coupled to the partition 211 in the transverse direction and the other end of the communication tube 260 is inserted and coupled to the communication hole 213 formed in the other partition 211, instead of inserting a separate insert plate into the depressed portion. Here, the communication tube 260 may be provided toward the first compartment 200*a* or the second compartment 200*b* of the header 210 before the header 210 and the tank 220 are coupled to each other and subsequently inserted and coupled to the communication hole 213 formed in the partition 211 in the transverse direction and the communication tube 260 may be joined in a portion in contact with the communication hole 213 through brazing, or the like.

Accordingly, it is easy to form a drain hole to drain condensate in the depressed portion, which is a transverse central portion of a header tank in the header tank formed in two rows, the degree of freedom in a formation size and position of the communication hole connecting the first compartment and the second compartment as the first row and the second row of the header tank is high.

A flange 261 may protrude outwardly from an outer circumferential surface of the communication tube 260 at one end so that the flange 261 may be caught by the partition 211 adjacent to the first compartment 200*a* or the second compartment 200*b*.

As illustrated, the flange 261 protrudes from one end of the linear tubular communication tube 260 to the outside of the outer circumferential surface, so that when the communication tube 260 is inserted and coupled to the communication hole 213 formed in the partition 211, the flange 261 may be caught by the partition 211, limiting a depth of insertion of the communication tube 260. Thus, the other end of the communication tube 260 at which the flange 261 is not formed may be easily positioned to match the inner surface of the partition 211 forming the second compartment 200*b* and the communication tube 260 may not be released in a state of being inserted into the communication hole 213. Further, the flange 261 may be tightly attached to the partition 211 and may be joined through brazing, or the like, enhancing a coupling force between the communication tube 260 and the partition 211.

A plurality of communication holes 213 are formed and spaced apart from each other in the header 210 in the longitudinal direction. The plurality of communication tubes 260 may be separately formed and individually inserted and coupled to the communication holes 213.

As illustrated, the plurality of communication holes 213 may be spaced apart from each other in the longitudinal direction of the header 210, and the communication tubes 260 may be inserted into the communication holes 213, respectively. Thus, it is easy to form the drain hole through which the condensate may be drained in the position between the communication tubes 260, the degree of freedom with respect to a formation position of the communication hole 213 is high, and it is easy to assemble the communication tube 260, regardless of position of the communication holes 213.

FIGS. 13 to 17 are exploded perspective views, assembled perspective views, and a cross-sectional view illustrating a modification of the header, the tank, and the insert plate of the second header tank according to the third exemplary embodiment, respectively.

As illustrated, the header 210 includes a plurality of communication holes 213 spaced apart from each other in the longitudinal direction, and the plurality of communication tubes 260 may be provided and connected to each other by a connection portion 262.

As illustrated, the plurality of communication holes 213 may be provided in the longitudinal direction of the header 210 and the integrated communication tubes 260 integrally connected to each other by the connection portion 262 may be inserted into the communication holes 213 at a time so as to be easily assembled thereto. Here, the connection portion 262 may connect one ends of the neighboring communication tubes 260 in the transverse direction. For example, the connection portion 262 may be formed in a linear line shape such that adjacent portions of the neighboring communication tubes 260 are connected to each other. When the integrated communication tubes 260 are inserted, into the communication holes 213 and coupled, the connection portion 262 is caught by the partition 211 to limit a depth of the inserted communication tube 260.

Here, as illustrated, the flange 261 may protrude from one end of the linear tubular communication tubes 260 to the outside of the outer circumferential surface and may also be connected to the connecting portion 262. Further, the neighboring communication tubes 260 may be connected to each other by the connection portion without a flange.

As in the first exemplary embodiment and the second exemplary embodiment, also in the third exemplary embodiment, the condensate drain hole 240 vertically penetrating through a portion where the central portion of the header 210 and the central portion of the tank 220 are coupled may be formed in the portion where the depressed portion 212 is formed, and the brazing ascertainment hole 242 may be formed so that, after the header 210 and the tank 220 are joined using brazing. Thereafter, it is inspected whether leakage occurs when a gas having specific pressure is injected through the brazing ascertainment hole 242 to confirm whether the joined portion based on brazing is completely sealed.

Figure 18:
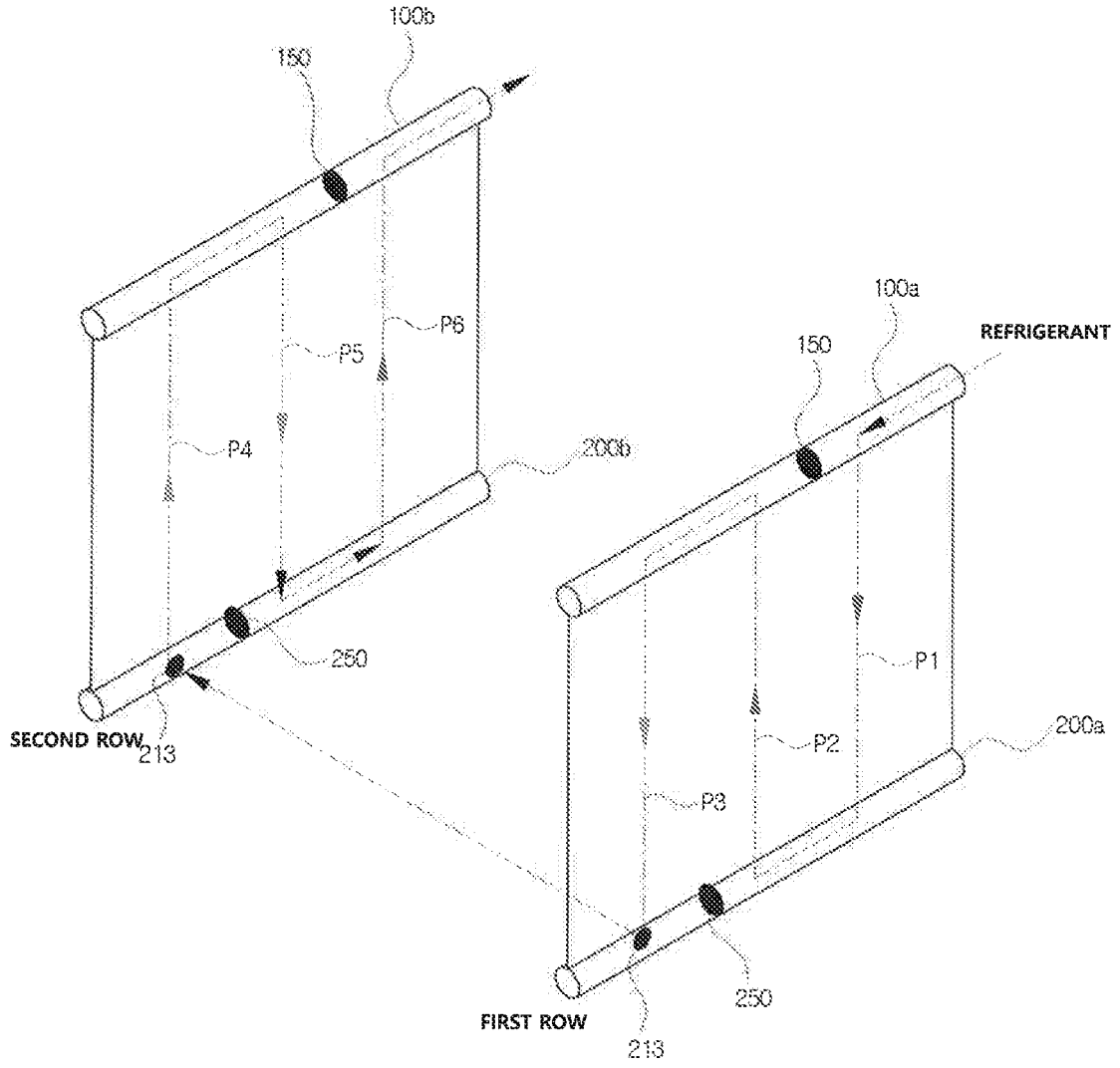
FIGS. 18 and 19 are conceptual views illustrating flow of a refrigerant in an evaporator of the present disclosure.
Figure 19:
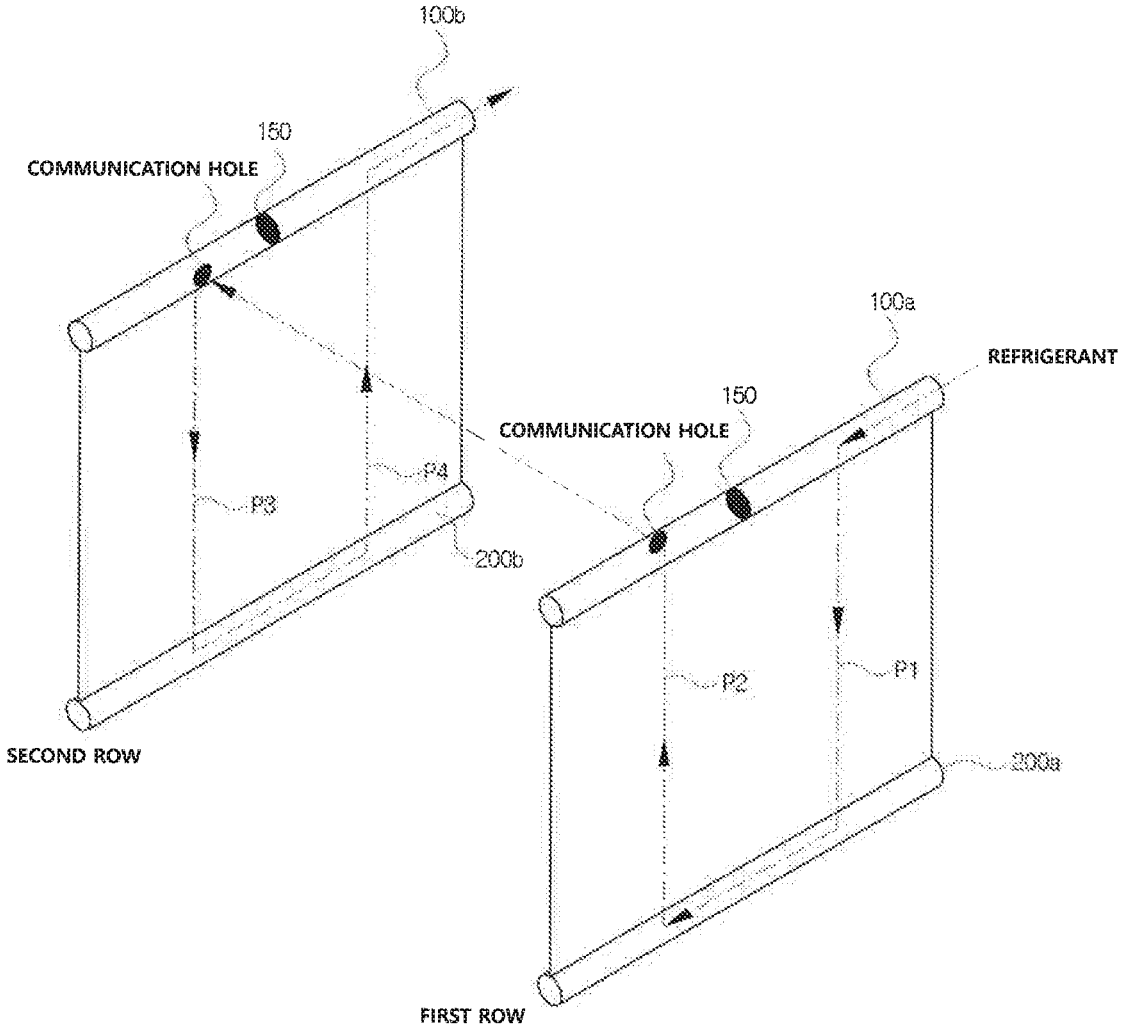

In all the evaporators according to the first to third exemplary embodiments of the present disclosure, the depressed portions may be formed in the tank 220 to form the partitions and the communication holes, and the insert plate may be inserted into the depressed portion formed in the tank 220 and coupled thereto, protrusions protruding from the communication holes may be formed, or the communication tubes may be inserted into the communication holes. Also, in the aforementioned exemplary embodiments, it is described that the communication holes are formed only in the second header tank 200 and connected by the insert plate or the communication tubes or by the protrusions, but the aforementioned configuration may also be applied to the first header tank 100 or may be applied to both the first header tank 100 and the second header tank 200. Also, as illustrated, the communication holes may be formed such that the entire perimeter of the communication holes in the longitudinal direction and transverse direction of the portion perforated in the transverse direction are clogged or the communication holes may be perforated in a penetrating manner, FIGS. 18 and 19 are conceptual views illustrating flow of a refrigerant in an evaporator of the present disclosure.

As illustrated, in any one or more of the first header tank 100 and the second header tank 200, the spaces forming the first compartments 100*a* and 200*a* and the second compartments 100*b* and 200*b* are partitioned to be divided in the longitudinal direction by the baffles 150 and 250 to form various types of path (flow path) in which a refrigerant may flow. For example, when flow of a refrigerant flowing in one of the downward or upward directions along the tubes 300 is referred to as one path, as illustrated in FIG. 18, a first path P1 in which a refrigerant introduced through an inlet tube 160 flows downwards along the tube 300 of the first row may be formed, a second path P2 in which the refrigerant flows upwards along the tube 300 may be formed, and a third path P3 in which the refrigerant flows downwards along the tube 300 may subsequently be formed. Thereafter, the refrigerant flows from the first row toward the second row through the communication hole 213 formed in the second header tank 300, a fourth path P4 in which the refrigerant flows upwards along the tube 300 in the second row may be formed, a fifth path P5 in which the refrigerant flows downwards along the tube 300 may be formed, and a sixth path P6 in which the refrigerant flows upwards along the tube 300 may be formed, and thus, the refrigerant flow path including a total of six paths in which the refrigerant is discharged through an outlet tube 170 may be formed. Alternatively, a refrigerant flow path including a total of four paths as illustrated in FIG. 19 may also be formed, and here, the communication hole 213 may be formed, in the first header tank 100. Also, a refrigerant path including a total of two paths in which the entire first row is configured as a first path and the entire second row is configured as a second path may be formed, and in addition, various flow paths may be configured and communication holes may be variously provided accordingly.

According to the exemplary embodiments, the evaporator may be advantageous in that the drain hole to drain condensate may be easily formed in the transverse central portion of the header tank formed in two rows, the degree of freedom of the size and position of the communication holes connecting the first and second rows of the header tank may be high, and durability of the portion in which the communication holes of the header tank are formed is high.

What is claimed is:

1. An evaporator comprising:

a first header tank and a second header tank arranged abreast of each other and spaced apart from each other at a predetermined distance, the first and second header tanks are partitioned by a partition to form a first row and a second row, the partition defines a first compartment, in the first row and a second compartment in the second row, the first and second compartments arranged in a transverse direction;

a plurality of tubes connected and fixed to the first header tank at first ends of the plurality of tubes, and the plurality of tubes are connected and fixed to the second header tank at second ends of the plurality of tubes; and fins interposed between the plurality of tubes, wherein the second header tank includes:

a header in which a depressed portion is formed by concavely depressing downwards a transverse central portion of the header in a longitudinal direction from an upper surface, the portion of the header in which the depressed portion is formed protrudes downwards to form the partition, the partition includes a pair of partitions spaced apart from each other, and a communication hole is formed in a penetrating manner in a transverse direction in each of the pair of partitions;

a tank comprising a first side in the transvers direction and a second side in the transverse direction and a central portion in a transverse direction, in which the transverse central portion of the tank is coupled to a lower end of the pair of partitions of the header and the first and second sides of the tank are coupled to the header; and an insert plate comprising a first surface and second surface, the insert plate positioned into the depressed portion of the header such that both surfaces of the insert plate are tightly attached to the pair of partitions, and the insert plate having a through hole provided at a position corresponding to the communication holes provided in the pair of partitions.

2. The evaporator of claim 1, wherein the second header tank has a condensate drain hole penetrating through the depressed portion in a vertical direction such that a lower external space of the tank and the depressed portion communicate with each other.

3. The evaporator of claim 2, wherein the insert plate includes a drainage flow path connecting an upper outer space of the header and the condensate drain hole.

4. The evaporator of claim 3, wherein the drainage flow path includes:

a first drainage flow path penetrating through both surfaces of the insert plate at a position spaced apart downwards from an upper end of the insert plate; and a second drainage flow path connected to the first drainage flow path on an upper side of the second drainage flow path, the second drainage flow path connected to the condensate drain hole on a lower side of the second drainage flow path, and penetrating through surfaces of the insert plate.

5. The evaporator of claim 4, wherein the condensate drain hole is provided in plurality and the plurality of drain holes are spaced apart from each other in the longitudinal direction, and the drainage flow path is provided in plurality, the plurality of drainage flow paths are provided in the insert plate and spaced apart from each other in the longitudinal direction to correspond to the condensate drain holes, respectively.

6. The evaporator of claim 4, wherein the first drainage flow path extends from a first side of the insert plate to a second side of the insert plate in the longitudinal direction, the first drainage flow path located on an upper end of the second drainage flow path.

7. The evaporator of claim 1, wherein a fixing tab protrudes from a lower portion of the insert plate and a coupling hole vertically penetrating through the depressed portion is formed in the second header tank, so that the fixing tab is inserted into the coupling hole and coupled therewith.

8. The evaporator of claim 1, wherein a vertically penetrating brazing ascertainment hole is provided in a transverse central portion of the tank where the lower end of the partition is coupled, such that the upper surface of the ascertainment hole is blocked by the depressed portion of the header.

* * * * *